US005145228A

United States Patent [19]

Boyle

[11] Patent Number: 5,145,228

[45] Date of Patent: Sep. 8, 1992

[54] RUNNING AND PULLING TOOL

[75] Inventor: Colin S. Boyle, Montrose, Scotland

[73] Assignee: Otis Engineering Corporation, Dallas, Tex.

[21] Appl. No.: 625,889

[22] Filed: Dec. 11, 1990

[30] Foreign Application Priority Data

Mar. 29, 1990 [GB] United Kingdom ..... 9007030

[51] Int. Cl.[5] ..... E21B 31/20

[52] U.S. Cl. ..... 294/86.25; 294/86.18

[58] Field of Search ..... 294/86.14, 86.17, 86.18, 294/86.19, 86.21, 86.25; 166/125, 137, 215, 217

[56] References Cited

U.S. PATENT DOCUMENTS

| | | | |
|---|---|---|---|
| 3,055,431 | 9/1962 | Clark, Jr. et al. | 166/217 X |
| 3,893,717 | 7/1975 | Nelson | 166/217 X |
| 3,942,833 | 3/1976 | Plunk | 294/86.18 |
| 4,431,054 | 2/1984 | Woodman | 166/125 |
| 4,488,596 | 12/1984 | Akkerman | 294/86.18 X |
| 4,583,591 | 4/1986 | Krause, Jr. et al. | 166/217 |
| 4,597,448 | 7/1986 | Baugh | 166/125 X |
| 4,767,145 | 8/1988 | Bullard | 294/86.18 |
| 4,838,594 | 6/1989 | Bullard | 294/86.18 |

*Primary Examiner*—Margaret A. Focarino
*Assistant Examiner*—Dean J. Kramer
*Attorney, Agent, or Firm*—Roland O. Cox

[57] ABSTRACT

A running and pulling tool is disclosed which is releasably connectible to a fishing neck on a well tool. The running pulling tool has an elongate mandrel on which a connector having dogs is slidably mounted for connecting to and releasing the dogs from a fishing neck. The connector is positioned in a first connecting position by a retainer which is moveable to a position permitting movement of the connector to a second position releasing from the fishing neck. A latch releasably positions the retainer in position for retaining the connector in the first position. The running pulling tool may be used to run and anchor a well tool in a well conduit and to retrieve an anchored well tool.

4 Claims, 3 Drawing Sheets

RUNNING AND PULLING TOOL

BACKGROUND OF THE INVENTION

This invention pertains to tools useful in servicing earth wells and pertains particularly to a running and pulling tool attachable in a string of well servicing tools and connectible to a well tool.

DESCRIPTION OF RELATED ART

Improved running and pulling tools have been developed which may be repeatedly forced or jarred downwardly and upwardly as required after connecting to a well tool fishing neck to run, pull or operate the well tool and later be released from the well tool at any desired time.

Both U.S. Pat. Nos. 4,767,145 and 4,838,594 to Bullard disclose structures of such running and pulling tools and are herein incorporated for reference. On manufacture and use, each of these tools was found to perform the functions for which they were designed very well, but proved to not be as long lasting as desired and each is comprised of a multiplicity of parts.

SUMMARY OF THE INVENTION

This running and pulling tool invention provides a rugged less costly tool which may also be repeatedly forced or jarred downwardly and upwardly as required after connecting to an internal fishing neck on a well tool to be lowered into a well conduit and operated to anchor in the conduit or operate an anchored well tool to release from the well conduit and be pulled from a well. The running pulling tool may be released from the fishing neck of a well tool after operation of the well tool by downward and upward force or jarring at any desired time by forcing or jarring downwardly. The upper section of the invention tool includes new simplified structure with better impact resistant which extends after application of a predetermined upward force on the tool after connection to a well tool fishing neck. The upper section automatically latches extended and in a position to permit operation of the running and pulling tool by subsequent predetermined downward force to release from the well tool fishing neck. After the invention running and pulling tool has connected to a well tool fishing neck and the well tool has been operated to anchor or release and is pulled back to surface, the invention tool may be easily released from the well tool and prepared for further use.

The principal object of this invention is to provide a less costly running and pulling tool having simplified structure.

An object of this invention is to provide a running and pulling tool having greater impact resistance.

Another object of this invention is to provide a running pulling tool which may be used to run and operate a well tool to anchor in a well conduit by downward jarring or forcing and upward forcing as required and later be released from the well tool with downward force.

Another object of this invention is to provide a running pulling tool which after connection to an anchored well tool to be pulled from a well may be forced downwardly and upwardly as required and later be released from the well tool by downward force.

Another object of this invention is to provide a running and pulling tool which may be easily released from a well tool which has been pulled from a well and be easily prepared for further use.

DESCRIPTION OF THE PREFERRED EMBODIMENTS

Figure 1A:
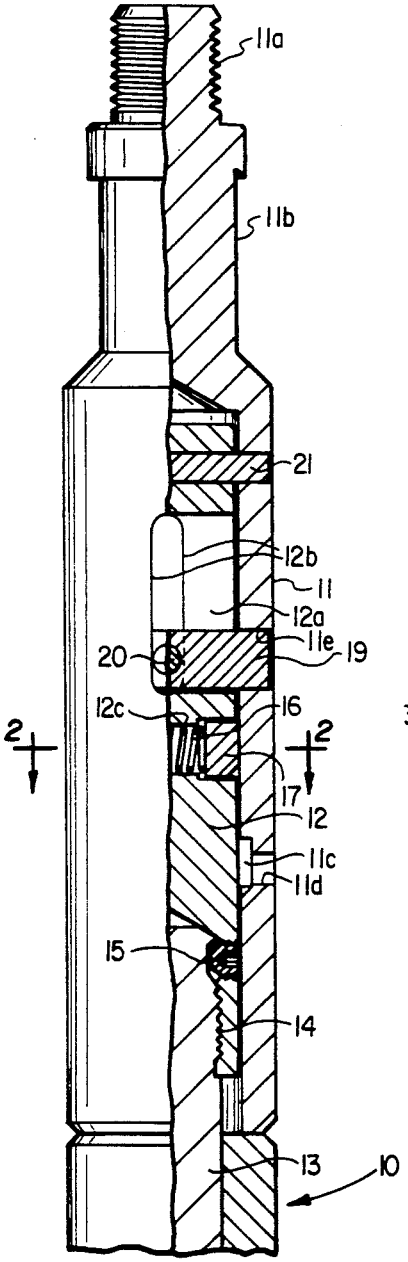
FIGS. 1A and 1B are a sectioned drawing in elevation of the running and pulling tool of this invention, shown connected to a well tool fishing neck.
Figure 1B:
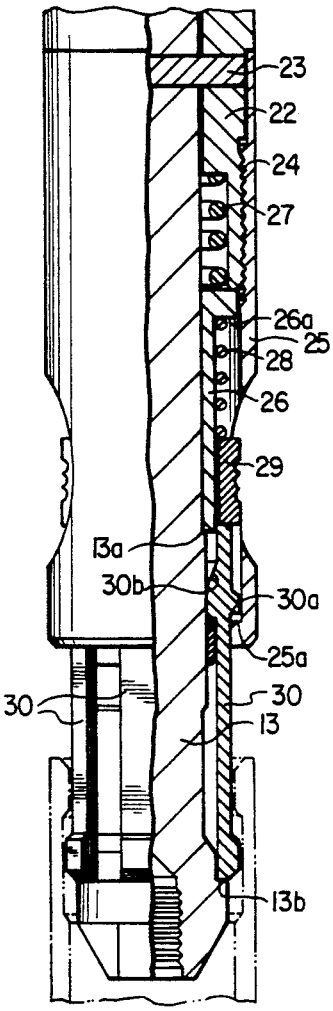

The running and pulling tool 10 shown in FIGS. 1A and 1B depicts the best mode contemplated for carrying out this invention. This running and pulling tool has an upper body 11 which is slidably mounted around an upper tool mandrel 12. There is a thread 11*a* on the upper end of the upper body which is useful to connect the tool 10 to a string of well servicing tools. Below thread 11*a* on body 11 is a fishing neck 11*b*. Lower in the upper body is an internal groove 11*c*. There are two openings 11*d* through body 11 into groove 11*c*.

Figure 2:
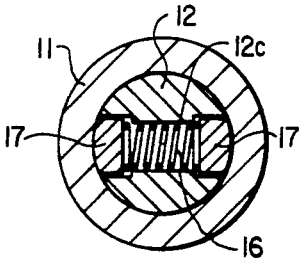
FIG. 2 is a drawing of the cross section along line 2—2 in FIG. 1.

Upper mandrel 12 is connected to mandrel 13 at 14 and the connection is secured with screw 15. The upper mandrel has a lateral opening 12*a*, slots 12*b*, and a lateral hole with counterbores 12*c*. Installed in hole 12*c* is a spring 16 and lugs 17 are slidably mounted in each counterbore (see also FIG. 2).

Mounted through lateral openings 11*e* in the upper body and 12*a* in the upper mandrel is a pin 19 which slidably connects upper body 11 to upper mandrel 12. Pin 19 is positioned in the upper body by small cross pin 20 through pin 19 and extending into body slots 12*b*. The upper body is releasably positioned on the upper mandrel by shearable pin 21 through the upper body and upper mandrel.

Figure 3:
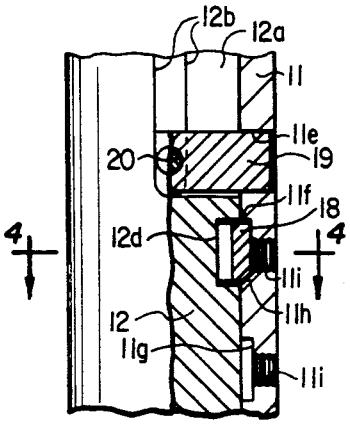
FIG. 3 is a sectioned drawing of a portion of FIG. 1 showing structure of an alternate latch.
Figure 4:
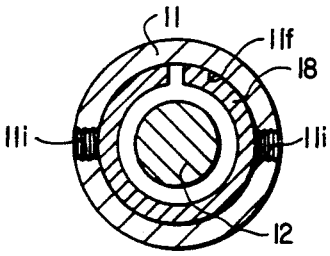
FIG. 4 is a drawing of the cross section along line 4—4 in FIG. 3.
Figure 5A:
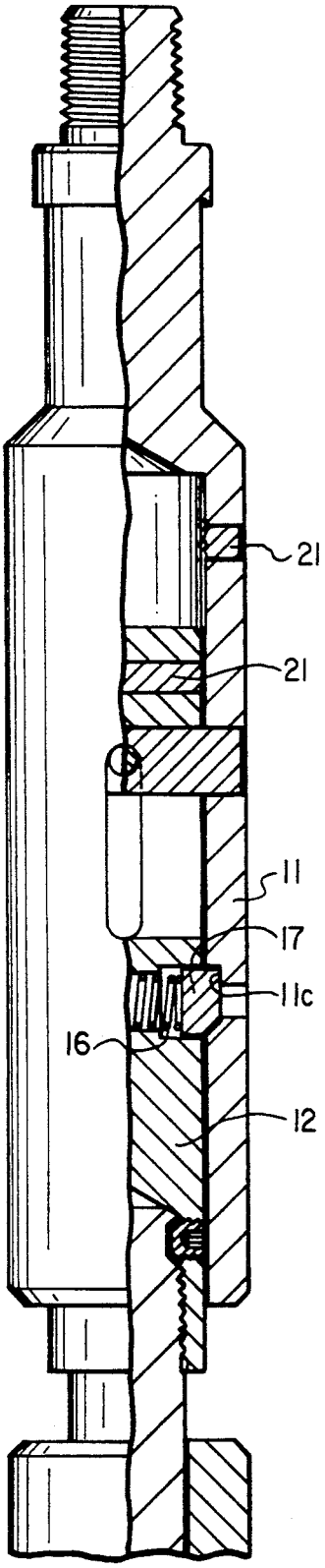
FIGS. 5A and 5B are a sectioned drawing in elevation of the invention tool shown latched in extended position.

When tool 10 is connected to an anchored well tool and upward force shears pin 21 and moves body 11 upwardly around the upper mandrel until groove 11*c* is adjacent lugs 17, spring 16 moves lugs 17 into groove 11*c* latching the upper body extended as shown in FIG. 5A. FIG. 3 shows alternate structure for latching the upper body extended which utilizes a spring in the shape of a "C" ring 18 mounted in a recess 12*d* around the upper tool mandrel 12 — See also FIG. 4. Upper body 11 has an upper internal groove 11*f* and an internal lower groove 11*g* and groove 11*f* has a camming surface 11*h*. Body 11 also has pairs of opposed threaded holes 11*i* in which screws may be installed to retract "C" ring 18 from internal grooves 11*f* or 11*g*.

Slidably mounted around lower mandrel 13 is a housing 22 (See FIG. 1). This housing is releasably positioned on the lower mandrel with a shearable pin 23 through the housing and lower mandrel. Connected to the housing by thread 24 is a skirt 25, which has an internal shoulder 25*a*.

Mandrel 13 has an upper shoulder 13*a* and a lower shoulder 13*b*. Slidably mounted around the mandrel is a ring 26 having a shoulder 26a. Housed in a bore in the lower end of housing 22 is a spring 27 which biases the housing upwardly and the ring downwardly into contact with upper mandrel shoulder 13a. A lower compressed spring 28 is mounted around ring 26 between ring shoulder 26a and a retainer ring 29. The retainer ring has a number of openings 29a and pivotally mounted in each opening is a dog 30. Each dog has an external shoulder 30a and a camming surface 30b. Spring 28 biases the retainer ring and each dog downwardly into fishing neck connecting position in contact with mandrel shoulder 13b.

To use the invention running pulling tool as a running tool requires insertion of the invention tool into the fishing neck of the tool to be run for automatic connection as shown in FIGS. 1A and 1B. Tool 10 is then connected in a string of well servicing tools by thread 11a and the well servicing tools carrying a well tool are lowered into a well conduit to be forced or jarred downwardly and upwardly to cause the well tool to anchor itself in the well conduit. Tool 10 connected to a well tool fishing neck as shown in FIG. 1 may be jarred or forced downwardly repeatedly and upwardly repeatedly on the anchored tool as required.

Figure 5B:
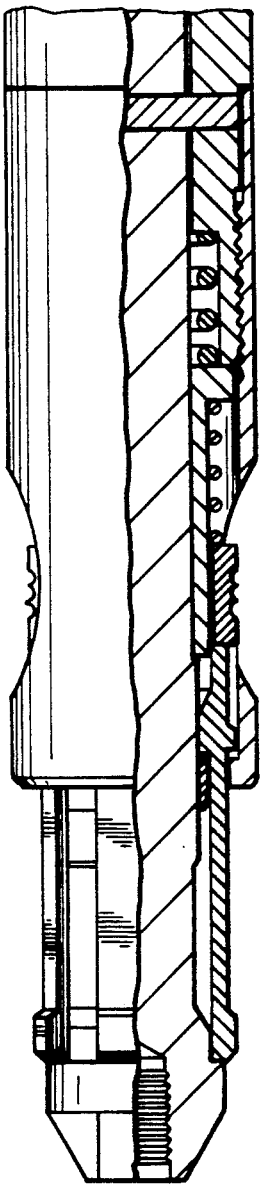

To release tool 10 from the anchored well tool fish neck, the well service tools and upper body 11 must be forced upwardly to shear pin 21, (if not already sheared) and slide body 11 upwardly around upper mandrel 12 and pins 19, 20 in slots 12b and openings 12a until groove 11c is adjacent lugs 17. Spring 16 then moves lugs 17 into groove 11c, latching body 11 in upper extended position on the mandrel as shown in FIGS. 5A and 5B.

If the alternate latching structure of FIG. 3 is used, upward movement of upper body 11 while shearing pin 21 moves camming surface 11h upwardly to cam expanded "C" ring 18 inwardly. Upward movement of body 11 and pins 19, 20 continue until groove 11g is adjacent "C" ring 18. Ring 18 expands, snapping into groove 11g and latches body 11 in upper extended position on upper mandrel 12. Now, if upward force or jarring is required on the anchored tool, this may be done repeatedly as required.

Figure 6A:
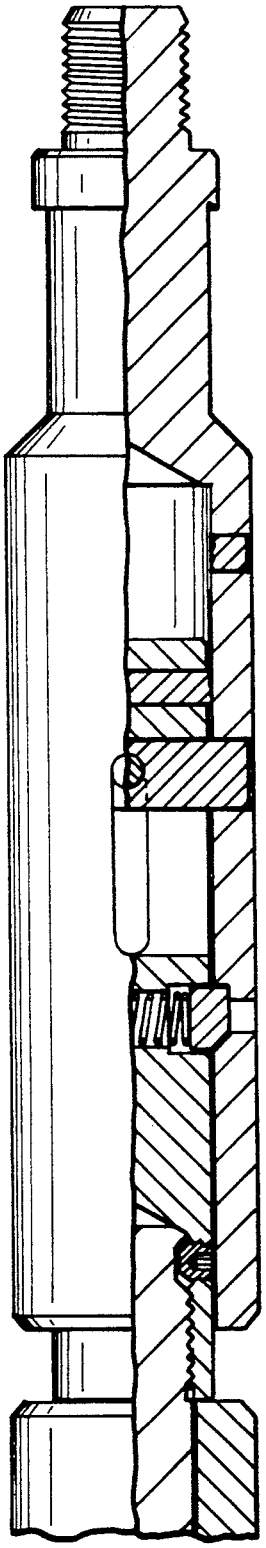
FIGS. 6A and 6B are a sectioned drawing in elevation showing the invention tool in released from fishing neck position.
Figure 6B:
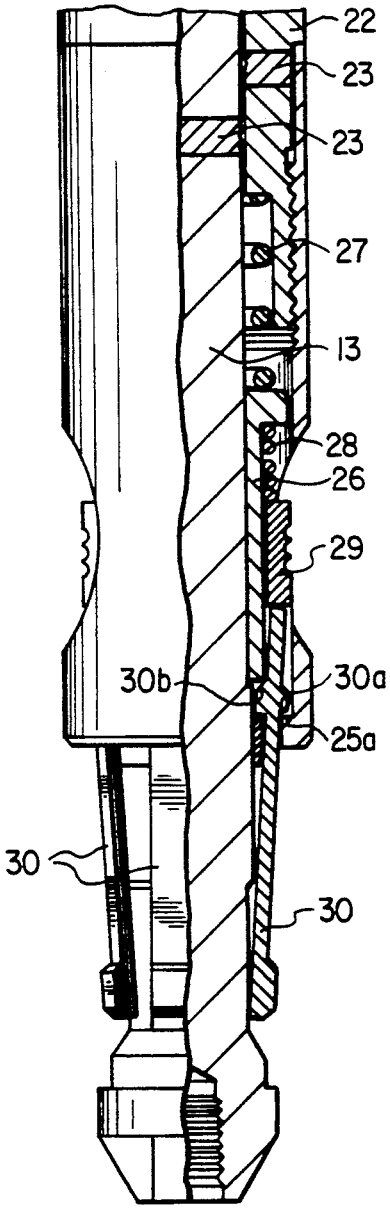

Now, applying downward force on extended tool 10 and the anchored well tool will move tool 10 downwardly into the anchored well tool fishing neck until the lower end of skirt 25 contacts the upper end of the well tool fishing neck. Downward force sufficient to shear pin 23 will permit spring 27 to move housing 22 and connected skirt 25 upwardly on mandrel 13. Skirt 25 lifts dogs 30, via skirt shoulder 25a and dog shoulder 30a, and retaining ring 29 and compresses spring 28 until dog camming surfaces 30b move over the lower outside corners of ring 26 and the dogs are cammed inwardly releasing the well tool fishing neck as shown in FIG. 6.

Tool 10 may now be raised back to surface and prepared for further use as a running or pulling tool by inserting a rod in each of upper body openings 11d and moving lugs inwardly from groove 11c, unlatching body 11 from mandrel 12. If the tool 10 has the alternate latch structure of FIG. 3, screws installed in threaded holes 11i are used to retract "C" ring 18 from groove 11g. Body 11 is moved downwardly from extended position until body and mandrel holes for pin 21 are aligned and sheared pieces of the pin are driven out. An unsheared pin 21 is inserted to again releasably position the upper body on the upper mandrel. Housing 22 and skirt 25 are now moved downwardly while compressing spring 27, until holes for shearable pin 23 in body 22 and mandrel 13 are aligned and the lower end of dogs 30 are in contact with mandrel lower shoulder 13b. Sheared pin 23 pieces are driven out and an unsheared pin is installed.

Running pulling tool 10 of FIGS. 1A and 1B may be used as a pulling tool by attaching to the lower end of a string of well servicing tools and lowering the servicing tools into a well until dogs 30 contact the upper end of an anchored well tool fishing neck. A small downward force may be required on tool 10 to compress spring 28 and move mandrel 13 downwardly and shoulder 13b out of contact with the lower end of dogs 30. Further downward movement of the mandrel permits the dogs to be cammed inwardly around the smaller diameter section of mandrel 13 by the well tool fishing neck until spring 28 can extend and push the dogs back into contact with shoulder 13b, connecting tool 10 to the anchored well tool fishing neck (See FIG. 1B). Tool 10 may now be forced or jarred repeatedly downward or repeatedly upward as required to operate the well tool to release from the well conduit. Any upward force sufficient to shear pin 21 will move upper body 11 upwardly around the upper mandrel and into extended position where the upper body is automatically latched by lugs 17 or "C" ring 18 of FIG. 3, as shown in FIG. 5A. If repeated downward forces followed by repeated upward forces or repeated upward forces followed by repeated downward forces do not operate the well tool to release from the conduit, then the tool 10 may be released from the well tool fishing neck by forcing tool 10 again downwardly against the anchored well tool to shear pin 23 and release tool 10 from the well tool fishing neck as previously described. The well servicing tools and tool 10 may be raised back to surface where parts of tool 10 may be repositioned an sheared pins replaced to prepare the running and pulling tool for further use as a running or pulling tool.

What I claim is:

1. A running and pulling tool for releasably connecting to a fishing neck on a well tool comprising:

(a) an elongate mandrel;

(b) connector means slidably mounted on said mandrel for connecting to and releasing from the fishing neck, said connector means movable from a first position connectible to the fishing neck to a second position releasing from said fishing neck;

(c) means releasably positioning said connector means in said first position on said mandrel;

(d) retaining means for retaining said connector means in said first position, said retaining means movable to a latched position permitting release and movement of said connector means to said second position, said retaining means including, a body slidably mounted around said mandrel and retractable latch means on said mandrel engageable with said retaining means body for latching said body to said mandrel, said retractable latch means including:

a recess around said mandrel, a retractable ring in said recess, said ring having a camming surface, upper and lower internal grooves in said retaining means body, said upper groove having a camming surface engageable with said retractable ring camming surface; and (e) means releasably positioning said retaining means on said mandrel.

2. The tool of claim 1 wherein the retaining means body has at least one threaded hole into the upper groove and at least one threaded hole into the lower groove.

3. The tool of claim 1 wherein the means releasably positioning the retaining means is a shearable pin through the retaining means body and the mandrel.

4. A running and pulling tool for releasably connecting to a fishing neck on a well tool comprising:

(a) an elongate mandrel;

(b) connector means releasably positioned around the lower portion of said mandrel in a first position for connecting to the fishing neck, said connector means moveable to a second position releasing from said fishing neck, said connector means including:

upper and lower external shoulders on said mandrel, a housing slidably mounted and releasably position on said mandrel above said upper shoulder, a skirt connected on said housing, a ring slidably mounted around said mandrel above said upper mandrel shoulder in said skirt, said ring having an external shoulder, upper biasing means in said housing biasing said housing upwardly, a retainer ring slidably mounted around said ring and mandrel below said ring external shoulder, said retainer ring having at least two openings therethrough, a dog mounted in each said retainer ring opening and extending from said skirt and lower biasing means in said skirt biasing said retainer ring and dogs downwardly into contact with said mandrel lower shoulder; and (c) retaining means releasably positioned on and slidably connected to said mandrel for retaining said connector means in said first position, said retaining means movable to a position permitting movement of said connector means to said second position, said retaining means including:

a body slidably mounted around the upper end of said mandrel, said mandrel having an elongate lateral opening therethrough, said body connected to said mandrel by a pin through said body and said opening, and said body releasably positioned on said mandrel by a shearable pin through said body and said mandrel above said mandrel opening, and retractable latch means on said mandrel, said retractable latch means including:

a recess around said mandrel, a retractable ring in said recess, said ring having a camming surface, upper and lower internal grooves in said retaining means body, said upper groove having a camming surface engageable with said retractable ring camming surface.

* * * * *